US010211512B2

(12) United States Patent
Toh et al.

(10) Patent No.: US 10,211,512 B2
(45) **Date of Patent: *Feb. 19, 2019**

(54) MULTI-BAND ANTENNA ON THE SURFACE OF WIRELESS COMMUNICATION DEVICES

(71) Applicant: Futurewei Technologies, Inc., Plano, TX (US)

(72) Inventors: Wee Kian Toh, San Diego, CA (US); Hongwei Liu, San Diego, CA (US); Ping Shi, San Diego, CA (US)

(73) Assignee: FUTUREWEI TECHNOLOGIES, INC., Plano, TX (US)

( * ) Notice: Subject to any disclaimer, the term of this patent is extended or adjusted under 35 U.S.C. 154(b) by 178 days.

This patent is subject to a terminal disclaimer.

(21) Appl. No.: 15/375,814

(22) Filed: Dec. 12, 2016

(65) Prior Publication Data

US 2017/0093019 A1 Mar. 30, 2017

Related U.S. Application Data

(63) Continuation of application No. 14/596,002, filed on Jan. 13, 2015, now Pat. No. 9,548,525.

(51) Int. Cl.
*H01Q 1/24* (2006.01)
*H01Q 1/22* (2006.01)
(Continued)

(52) U.S. Cl.
CPC ..... *H01Q 1/2291* (2013.01); *H01Q 1/24* (2013.01); *H01Q 1/243* (2013.01); *H01Q 1/38* (2013.01); *H01Q 1/42* (2013.01); *H01Q 1/48* (2013.01); *H01Q 1/521* (2013.01); *H01Q 5/10* (2015.01); *H01Q 9/0407* (2013.01); *H01Q 9/42* (2013.01); *H01Q 21/28* (2013.01); *H01Q 5/371* (2015.01)

(58) Field of Classification Search
CPC ..... H01Q 1/2291; H01Q 1/22; H01Q 1/24; H01Q 1/243; H01Q 1/38; H01Q 1/48; H01Q 5/10
See application file for complete search history.

(56) References Cited

U.S. PATENT DOCUMENTS 3,757,344 A 9/1973 Pereda
4,849,765 A 7/1989 Marko
(Continued)

FOREIGN PATENT DOCUMENTS

CN 1650472 A 8/2005
CN 103636064 A 3/2014

*Primary Examiner* — Tho G Phan
(74) *Attorney, Agent, or Firm* — Slater Matsil, LLP

(57) ABSTRACT

An embodiment wireless communication device includes a circuit board and a cover having a back surface covering a portion of a first surface of the circuit board and an opening in the back surface. A top antenna is disposed within the cover and is electrically connected to the circuit board at a first feed point on a first edge of the circuit board. A secondary antenna disposed within the cover has a first antenna portion connected to the circuit board at a second feed point, and a second antenna portion of the second antenna extends laterally from a second edge of the circuit board over the first surface of the circuit board and between the back surface of the cover and the first surface of the circuit board such that at least a portion of the second antenna portion is exposed through the opening in the back surface.

20 Claims, 3 Drawing Sheets

(51) Int. Cl.

| | |
|---|---|
| ***H01Q 9/04*** | (2006.01) |
| ***H01Q 1/38*** | (2006.01) |
| ***H01Q 5/10*** | (2015.01) |
| ***H01Q 1/42*** | (2006.01) |
| ***H01Q 1/52*** | (2006.01) |
| ***H01Q 9/42*** | (2006.01) |
| ***H01Q 21/28*** | (2006.01) |
| ***H01Q 1/48*** | (2006.01) |
| *H01Q 5/371* | (2015.01) |

(56) References Cited

U.S. PATENT DOCUMENTS 4,924,237 A * 5/1990 Honda ..... H01Q 1/243 343/702
6,614,399 B2 9/2003 Trumbull et al.
6,618,020 B2 9/2003 Wang et al.
6,943,738 B1 * 9/2005 Mattsson ..... H01Q 1/243 343/700 MS
6,952,187 B2 10/2005 Annamaa et al.
6,963,310 B2 * 11/2005 Horita ..... H01Q 1/08 343/700 MS
7,903,035 B2 3/2011 Mikkola et al.
8,542,154 B2 9/2013 You et al.
8,928,538 B2 1/2015 Montgomery et al.
9,966,659 B2 * 5/2018 Chakam ..... H01Q 1/1214
2007/0035454 A1 2/2007 Zarnowitz et al.
2009/0040115 A1 2/2009 Zhang et al.
2012/0013511 A1 * 1/2012 Sumi ..... H01Q 1/243 343/702
2013/0016024 A1 1/2013 Shi et al.
2013/0176189 A1 7/2013 Kodama et al.
2013/0187818 A1 7/2013 Desclos et al.
2014/0341197 A1 11/2014 Hong et al.
2015/0042520 A1 2/2015 Zhao et al.

* cited by examiner

MULTI-BAND ANTENNA ON THE SURFACE OF WIRELESS COMMUNICATION DEVICES

This application is a continuation of U.S. application Ser. No. 14/596,002, filed Jan. 13, 2015 which application is hereby incorporated by reference

TECHNICAL FIELD

The present invention relates generally to systems and methods for wireless communications devices, and, in particular embodiments, to systems and methods for providing multi-band antennas with improved performance in wireless communications devices.

BACKGROUND

Industrial design of modern wireless devices is evolving towards lower profile devices. For example, many devices have thicknesses smaller than 10 mm. Additionally, modern wireless devices increasingly make use of metalized structures, such as metal rings, metal slots, and metal cases and the like. These modern wireless devices include cellular phones, tablets, or wearables such as watches, eyeglasses and virtual reality headsets or the like. Wireless devices require multiple multi-band radio frequency (RF) antennas to operate on, or near, users. Typical antennas include cellular main antennas, diversity antennas, wireless networking (e.g., WiFi, 802.11 or Bluetooth) antennas, near field antennas (e.g., near field communication or wireless charging) and global positioning (e.g., GPS) antennas. Multiple multi-band antennas have to be co-designed to cooperate with each other and with other electromagnetic components such as speakers, LCD screens, batteries, sensors, etc. However, antennas in proximity to each other result in low isolation, reduced efficiency, and increased channel interference. In some devices, a top antenna and main antenna are both used to communicate on a single band or frequency, with active antenna switches changing between the top antenna and bottom main antenna when one of antennas is obstructed by the user, for example, by the user's hand position on the device. The performance of the top antenna becomes increasingly important as it is frequently located next to other antennas such as WiFi & GPS combination antennas.

SUMMARY

An embodiment wireless communication device includes a circuit board and a cover having a back surface covering a portion of a first surface of the circuit board and an opening in the back surface, wherein the back surface comprises a substantially radio frequency (RF) opaque material. A top antenna is disposed within the cover and is electrically connected to the circuit board at a first feed point on a first edge of the circuit board. A secondary antenna is disposed within the cover and has a first antenna portion electrically connected to the circuit board at a second feed point, and a second antenna portion of the second antenna extends laterally from a second edge of the circuit board over the first surface of the circuit board and between the back surface of the cover and the first surface of the circuit board such that at least a portion of the second antenna portion is exposed through the opening in the back surface.

An embodiment wireless communication device includes a circuit board, a first transceiver connected to the circuit board and a first antenna connected to the first transceiver via a first feed point on the circuit board and is configured to communicate in a first radio frequency (RF) band. The first antenna extends from a first edge of the circuit board. A second transceiver is connected to the circuit board and a second antenna is connected to the second transceiver via a second feed point on the circuit board and is configured to communicate in a second RF band and a third RF band. A first portion of the second antenna extends from the first edge of the circuit board and away from the first antenna and a second portion of the second antenna extends over a first side of the circuit board.

An embodiment method includes providing a user interface on a wireless communications device having a cover disposed around a circuit board, a first antenna and a second antenna. The first antenna is configured to communicate in a first radio frequency (RF) band, and the first antenna extends from a first edge of the circuit board. The second antenna is configured to communicate in a second RF band and a third RF band. A first portion of the second antenna extends from the first edge of the circuit board and away from the first antenna, and a second portion of the second antenna extends over a first side of the circuit board. The method further includes performing a first communication in response to a user input through the user interface and by way of a first communication service that uses the first band and causes the wireless communications device to communicate on the first antenna. A second communication is performed by way of a second communication service that uses the second band and causes the wireless communications device to communicate on the second antenna at a same time as at least part of the first communication.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Figure 1:
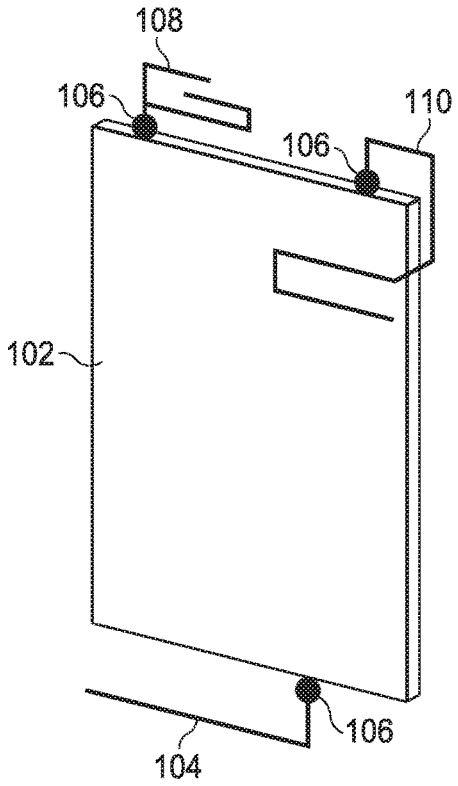
FIG. 1 is a diagram illustrating arrangement of multiple antennas for a handheld communication device according to some embodiments.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Additionally, the methods and apparatuses described may be applied to wireless communications system antenna layout and design, but are not specifically limited to the same.

Modern communications devices provide the ability to communicate on multiple distinct channels in different frequency bands simultaneously, providing increased data throughput and multiple simultaneous wireless communications services in a single device. Many wireless communications devices are designed to be multi-band devices, with the ability to communicate on different cellular frequency bands, such as the 700 MHz-900 MHz bands, 1700 MHz, 1900 MHZ, 2100 MHz and 2500 MHz bands. Additionally, wireless devices frequently have additional features such as WiFi connectivity on, for example, the 2.4 GHz, 3.6 GHz, 5 GHz bands, or the like, and GPS on the 1227 MHz and 1575 MHz frequencies. The ability to communicate on different frequencies or bands can be provided by multi-band antennas. For example, in some devices, cellular service is provided by an antenna or set of antennas that is configured to communicate on two or more of the different cellular frequency bands, and supplemental services are provided by a WiFi/GPS antenna that is configured to communicate on the WiFi and GPS bands.

However, in some instances, the cellular bands and the WiFi or GPS bands may overlap, causing interference then the cellular and GPS/WiFi antennas are in close proximity. Additionally, in relatively small devices such as handheld cellular phones, tablets, or wearables such as watches, eyeglasses and virtual reality headsets, the antennas for similar frequency bands are allocated increasingly smaller space. For example, cellular antennas optimized for the 824-960 MHz and 1700-2700 MHz ranges require large volume to work efficiently. Such frequencies are close to, or overlap, the GPS and WiFi signals. The overlapping bands, combined with the proximity of the cellular antennas and GPS/WiFi antennas introduces interference in the antennas. For example, transmission on a cellular antenna in the 1700 MHz band may cause interference with GPS signals in the 1575 MHz frequency band. Interference with such a signal is particularly problematic since the GPS signals are transmitted from satellites, resulting in weak and easily overpowered signals.

Additionally, in order to reduce the footprint of antennas and reduce the overall size of the handheld device, multiple antennas are disposed at the ends of the device. This arrangement also permits improved wireless connectivity since having the antennas in the ends of the device generally avoids the areas where users tend to grasp the device, which could block wireless signals from antennas in the sides of front or back surfaces of the devices. In some embodiments, improved connectivity is also provided, for example, by multiple antennas in different locations, with the device switching between antennas when reduced signal power is detected.

Various systems and methods described herein provide for feeding multiple radiating elements of the antenna on various surfaces of the wireless device to achieve selective antenna radiation on different sides of the wireless device. Using different feed locations and antenna surfaces improves, for example, 4G LTE antenna performance of a wireless device. Additionally, routing the portions of the GPS/WiFi antenna on different sides of the wireless device improves the antenna efficiency and isolation from other antennas that share the same or overlapping frequency bands. An opening in the back surface of the device cover permits emission of antenna radiation that would otherwise be opaque to radio signals. Different portions of the GPS/WiFi antenna resonate on different sides of a shared ground plane, thus distributing the current and improving efficiency in using the available volume within the wireless device.

The systems and methods described herein provide a GPS/WiFi antenna that extends from the front of a handheld device to the back side of the device, providing increased spacing between the GPS/WiFi antenna and the top cellular antenna. Increased spacing between the GPS/WiFi antenna and top cellular antenna reduces the interference between the antennas. Additionally, improved antenna resonance and antenna radiation propagation is achieved with the back side portion of the GPS/WiFi antenna exposed in an opening in a metal back cover of the device.

FIG. 1 is a diagram illustrating arrangement of multiple antennas for a handheld communication device according to some embodiments. A main antenna 104 connects to a circuit board 102 at a feed point 106 at a bottom edge of the circuit board 102. A top antenna 108 and secondary antenna 110 are disposed at a top edge of the device and connect to the circuit board 102 by respective feed points 106 at the top edge of the circuit board 102.

The circuit board 102 may be a printed circuit board (PCB) such as a 10-layer board having 10 layers of conductive elements spaced part and electrically insulated by, for example, dielectric or insulating layers such as fiberglass, polymer, or the like. Components such as displays, touchscreens, input buttons, transmitters, processors, memory, batteries, charging circuits, system on chip (SoC) structures, or the like may be mounted on or connected to the circuit board 102, or otherwise electrically connected by, the conductive layers in the circuit board 102. The circuit board 102, in some embodiments, acts as a ground plane for the antennas 104, 108, and 110.

In some embodiments, the main antenna 104 and top antenna 108 are multi-mode antennas configured to communicate, transmit, and/or receive on multiple cellular frequency bands. In some embodiments, the main antenna 104 and the top antenna 108 are switched antennas or smart antennas selected for frequency matching performance. Circuitry on the circuit board 102 is configured to sense the incoming or received radio signals for the active antenna, and to switch the cellular antenna 104, 108 over which cellular communications are received or transmitted. In some embodiments, the circuitry switches between the antennas 104, 108 when the incoming signal power drops below a predetermined threshold, or to switch to the cellular antenna 104, 108 having the highest signal strength. In other embodiments, the main antenna 104 or top antenna 108 are selected based on the cellular band in which the device will communicate. An active RF switch may switch between the cellular antennas 104, 108 to improve antenna performance at different frequency bands.

The device further includes one or more secondary antennas 110 for providing communication capabilities for communications services such as Bluetooth, GPS, WiFi, or the like. In some embodiments, the secondary antenna 110 is a dual mode antenna configured to communicate, transmit and/or receive on multiple bands for multiple communications services. For example, the secondary antenna 110 may be a GPS/WiFi antenna that communicates or receives GPS positioning signals on a GPS frequency, set of frequencies or frequency band. Such a GPS/WiFi antenna may also be configured to transmit and receive WiFi signals on, for example, 2.4 GHz, 3.6 GHz or 5 GHz WiFi bands. The GPS/WiFi antenna 110 extends from the top edge of the circuit board 102, along the top edge of the circuit board 102 and device, along a side of circuit board 102 and device, and then across the back surface of the circuit board 102. Such an arrangement permits a portion of the GPS/WiFi antenna to be spaced apart from the top antenna 108 farther than if the antenna were solely along the top edge of the circuit board 102. Additionally, the circuit board 102 shields the lateral portion of the GPS/WiFi antenna 110 from the top antenna 108 since the circuit board 102 acts as a ground plane, reflecting the transmissions of the top antenna 108. Such an arrangement of antennas 108, 110 with respect to the circuit board 102 or ground plane provide additional shielding in a reduced space when using the both the top antenna 108 and dual mode GPS/WiFi antenna 110.

Figure 2:
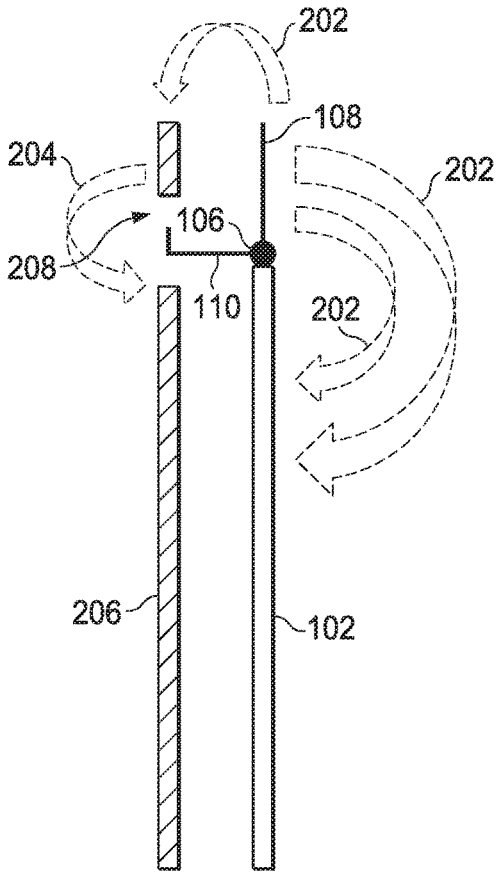
FIG. 2 is a diagram illustrating a side view of a circuit board with near-field radiation patterns for antennas formed according to the embodiments.

FIG. 2 is a diagram illustrating a side view of the circuit board 102 with near field radiation patterns for antennas formed according to the embodiments. In some embodiments, the circuit board 102 and antennas 108, 110 are disposed in a cover, case, protective shell, or the like. The back surface 206 of the cover is formed form a radio opaque material such as a metal or the like. The radio opaque material of the back surface 206 blocks radio signals. The lower portion of the GPS/WiFi antenna 110 extends between the circuit board 102 and the back surface 206 of the cover, and is exposed by an opening 208 in the back surface 206. The opening 208 in the back surface 206 of the cover permits the GPS/WiFi antenna 208 to transmit or receive through the opening 208, permitting a radiation aperture 204 for the GPS/WiFi antenna 110 at the back of the device. Additionally, the radio opaque material of the back surface 206 shields the GPS/WiFi antenna 110 from transmissions or radiation apertures 202 formed by the top antenna 108.

Figure 3:
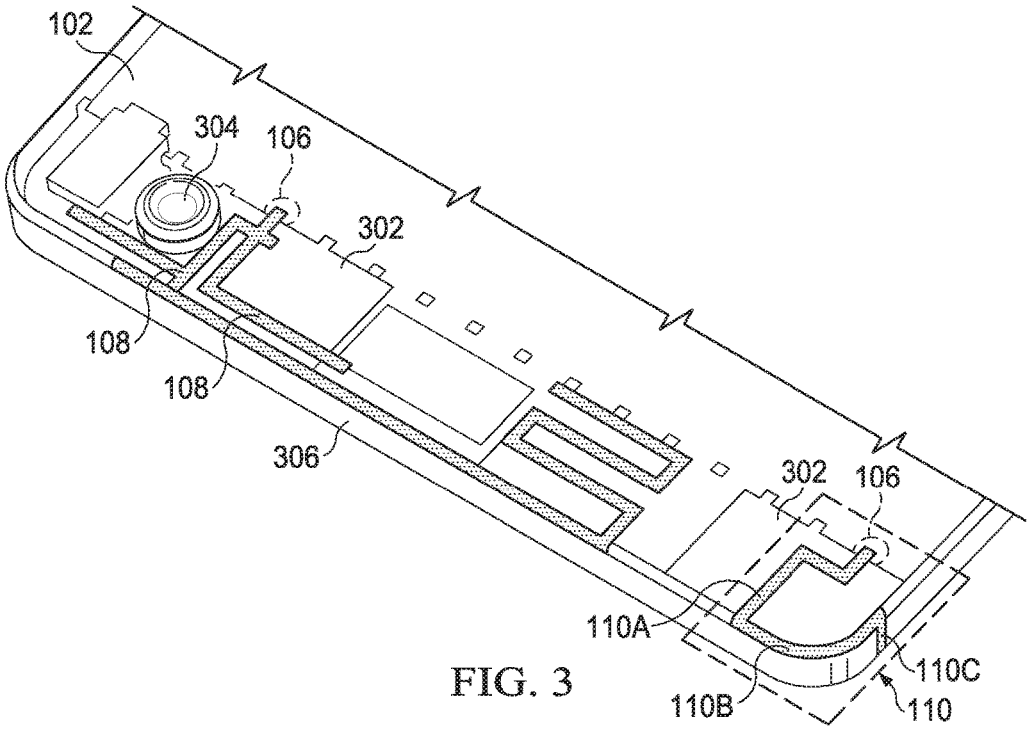
FIG. 3 is a diagram illustrating a cutaway view of the top antenna and GPS/WiFi antenna from the front side of the device according to an embodiment.

FIG. 3 is a diagram illustrating a cutaway view of the top antenna 108 and GPS/WiFi antenna 110 from the front side of the device according to an embodiment. The circuit board 102 is arranged within the cover, with the antennas connecting to the top side of the circuit board 102 at separate feed points 106. Dielectric antenna carriers 302 are disposed in the cover, and in some embodiments, the top antenna 108 and GPS/WiFi antenna 110 are disposed on separate antenna carriers 302 and extend along the case edges 306. Additional components, such as a camera 304, may be disposed within the case. The feed points 106 may be where the antennas 108, 110 connect to the circuit board 102 by soldering, ultrasonic welding, a wired connection, a plug, a spring contact, or the like. The antenna carriers 302 comprise dielectric or otherwise electrically insulating materials such as polymers or the like.

The GPS/WiFi antenna 110 has a first antenna portion 110A that extends away from feed point 106 and the top edge of the circuit board 102. A second antenna portion 110B extends along the top edge of the case. In some embodiments, the second antenna portion 110B extends along a corner of the case to a side or second edge of the case. A third antenna portion 110C extends vertically, and in some embodiments, extends the thickness of the circuit board 102 to provide a connection on the back side or back surface of the circuit board 102. While the third antenna portion 110C is illustrated as being disposed on the antenna carrier 302, the second antenna portion 110B may, in some embodiments, extend to the edge of the circuit board 102 so that the third antenna portion 110C is directly adjacent to the circuit board 102. Additionally, the GPS/WiFi antenna 110 may, in other embodiments, be formed on the interior surface of the case, such as along the case edges 306. In other embodiments, the top antenna 108 or GPS/WiFi antenna 110 may be wholly or partially integrated into the case. For example, the first antenna portion 110A may be formed on the antenna carrier 302, and may contact a conductive portion of the case edge 306, which may have a conductive portion integrated therein that acts as the second antenna portion 110B and/or third antenna portion 110C, providing connectivity for a fourth antenna portion (not shown, see FIG. 4, element 110D) that extends across the back surface of the circuit board 102.

Figure 4:
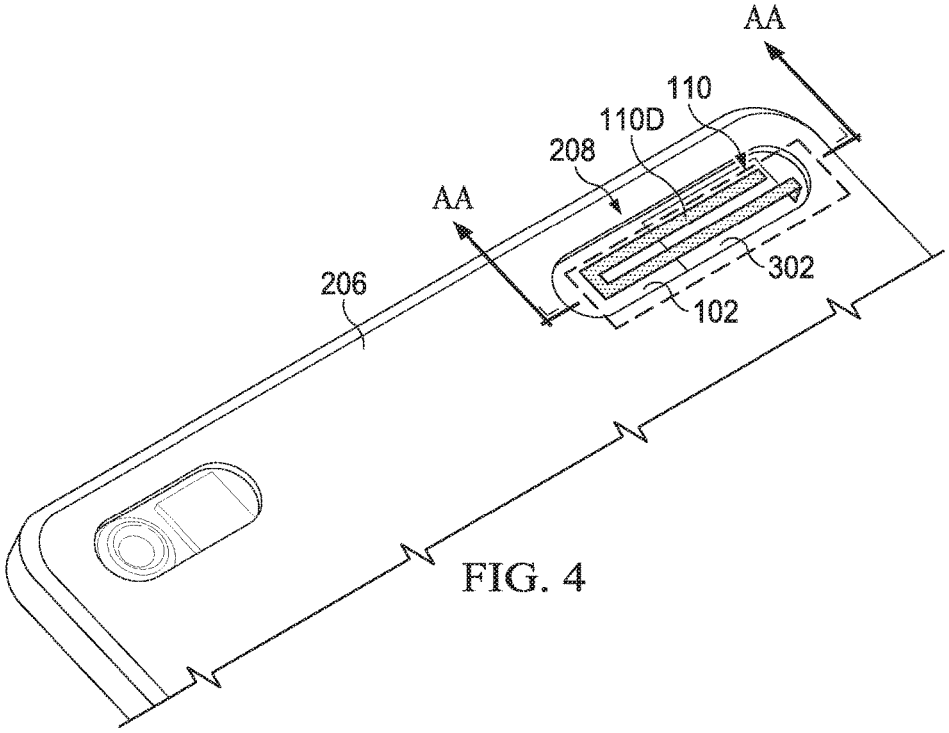
FIG. 4 is a diagram illustrating a portion of the GPS/WiFi antenna and back surface of the cover according to an embodiment.

FIG. 4 is a diagram illustrating a portion of the GPS/WiFi antenna 110 and back surface 206 of the cover according to an embodiment. The GPS/WiFi antenna 110 has a fourth antenna portion 110D that extends from the edge of the cover, over the antenna carrier 302 and over the back side of the circuit board 102. The fourth antenna portion 110D has longer portions that extend generally in the same direction as the top edge of the circuit board 102 so that the fourth antenna portion extend laterally across the back side of the circuit board 102. The embodiment GPS/WiFi antenna 110 has reduced volume and fewer interference or isolation issues with the top antenna.

The multi-band GPS/WiFi antenna makes use of a cavity and/or opening 208 on the back surface of the wireless device cover to provide improved antenna resonance. In some embodiments, the fourth antenna portion 110D is configured to resonate at, for example, the GPS frequency band, while the first antenna portion (See FIG. 3, element 110A) is configured to resonate at, for example, the WiFi frequency range. Different portions of the GPS/WiFi antenna 110 resonating in different regions at different frequencies results in the resonating regions having a greater current density than other regions of the antenna. For example, the first antenna portion is configured to resonate when communicating in WiFi frequency bands, resulting in a greater current density in the first antenna portion than the second antenna portion when communicating in a WiFi frequency band. Similarly, the second antenna portion is configured to resonate when communicating in GPS frequency bands, resulting in a greater current density in the second antenna portion than the first antenna portion when communicating in a GPS frequency band.

A multi-band antenna of one feed could resonate and radiate on different sides of the wireless device depending on the frequency of operation. The first antenna portion 110A and fourth antenna portion 110D can be tuned to resonate at a particular frequency by tuning the length of the particular antenna portion, or by tuning the farthest distance the antenna portion extends from the antenna feed point. In some embodiments, the GPS/WiFi antenna 110 is a quarter wave antenna, with the relevant portions of the antenna having a resonant portion with a length that is approximately one quarter of the wavelength of the resonant frequency. For example, a GPS signal at 1575 MHz has a wavelength of about 19 cm, resulting in a resonating quarter wave antenna length of about 4.75 cm. Similarly, a WiFi signal at 2.4 GHz has a wavelength of about 12.5 cm, resulting in a resonating quarter wave antenna length of about 3.125 cm.

The additional resonances provided by the opening 208 on the back surface 206 result in improved isolations for the fourth antenna portion 110D from other antenna elements on the opposite side of the device and improved radiation performance. The opening 208 in the back surface 206 of the cover is sized to expose the fourth antenna portion 110D. Thus, when the fourth antenna portion 110D is a GPS resonant antenna portion, the fourth antenna portion may be about 4.75 cm long, and the opening may be between about 4.75 cm long and about 6 cm long. In some embodiments, the opening 208 has a shield or opening cover formed from a substantially radio transparent material. The cover provides protection for the fourth antenna portion 110D and seals the device cover. Additionally, in some embodiments, the fourth antenna portion 110D may be formed on the surface of the cover, or embedded within the cover. In such an embodiment, the GPS/WiFi antenna 110 may be formed in multiple discrete portions that are connected during assembly of the device.

Figure 5:
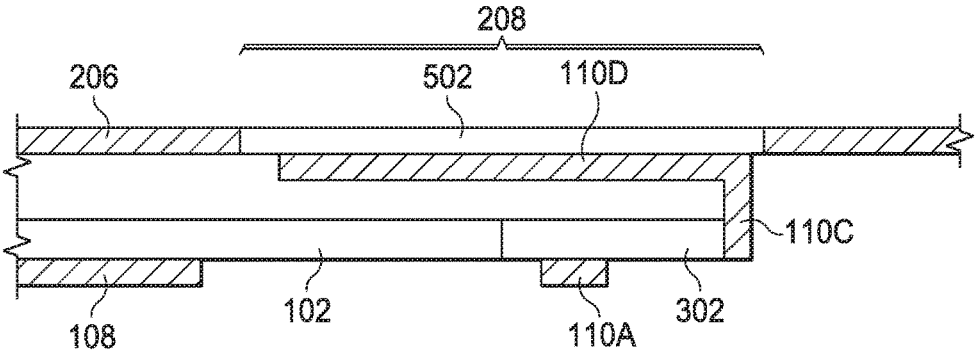
FIG. 5 is a cross-sectional illustrating an arrangement of an opening 208 in the back surface 206 of the device cover according to an embodiment.

FIG. 5 is a cross-sectional view taken along plane AA in FIG. 4 and illustrating an arrangement of an opening 208 in the back surface 206 of the device cover according to an embodiment. In this view, the GPS/WiFi antenna is shown as discontinuous due to the layout of the first antenna portion 110A. The first antenna portion 110A is disposed on the antenna carrier 302 and extends over and around the edge of the antenna carrier 302. The third antenna portion 110C extends perpendicular to the back surface of the circuit board to the fourth antenna portion 110D. While not shown, the second antenna portion 110B (see FIG. 2) electrically connects the first antenna portion 110A to the third antenna portion 110C. The fourth antenna portion 110D extends laterally along, or under, the back surface of the circuit board 102 in the opening 208. In the illustrated embodiment, the fourth antenna portion 110D is disposed directly on the shield 502, but in other embodiments, the fourth antenna portion 110D is disposed directly on the back side of the antenna carrier 302 and circuit board 102 while being spaced apart from the shield 502. At least a portion of the circuit board 102 is disposed between portions of the top antenna 108 and portions of the fourth antenna portion 110D, providing shielding between the two radiation emitting bodies and increasing the antenna isolation.

Figure 6:
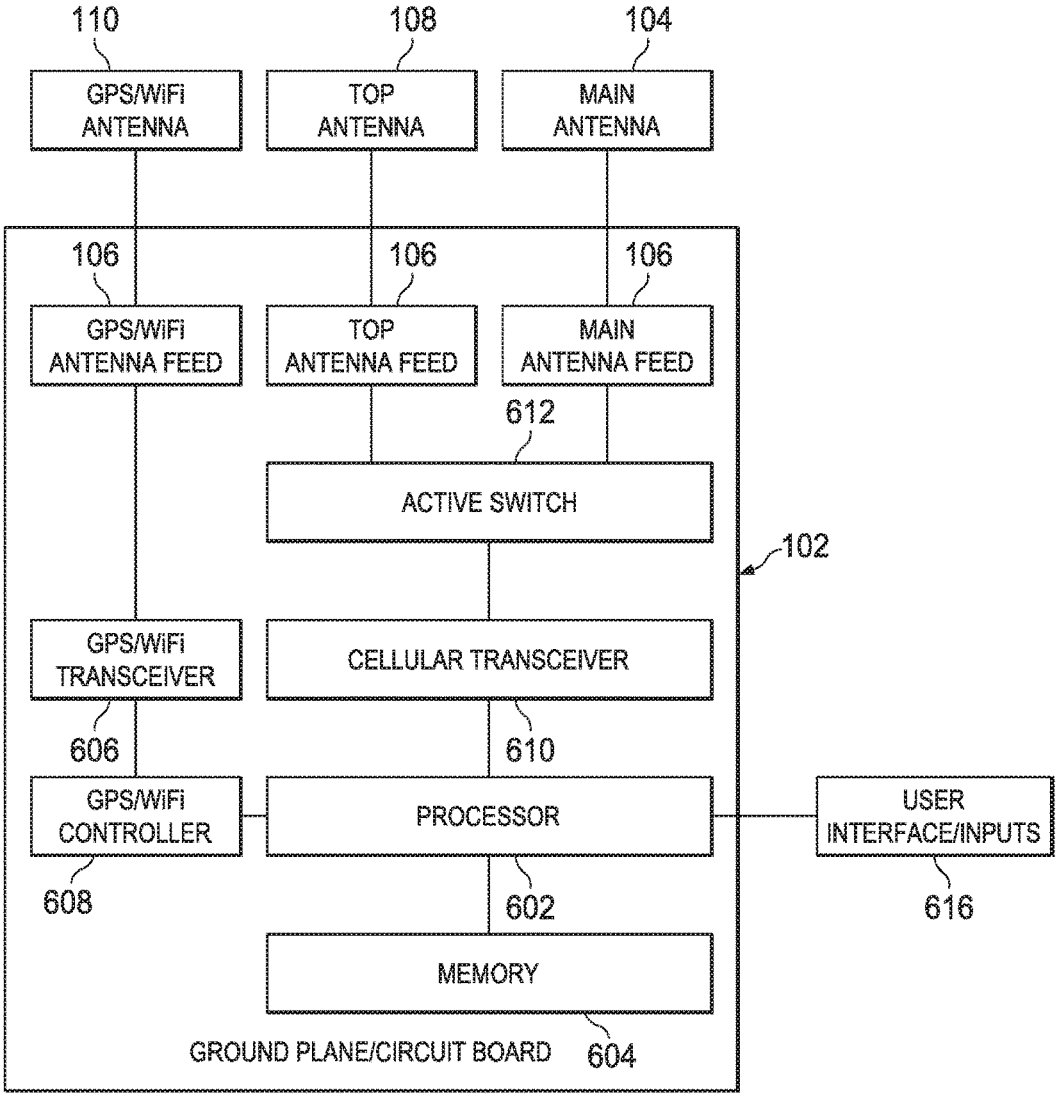
FIG. 6 is a functional block diagram of a device with cellular antennas and a GPS/WiFi antenna according to an embodiment.

FIG. 6 is a functional block diagram of a device with cellular antennas 104, 108 and a GPS/WiFi antenna 110 according to an embodiment. The device may be any wireless communications device such as a cellular phone, tablet, or wearable such as a watch, eyeglasses and virtual reality headset, or satellite phone, personal communication device, computer, or the like. The device may include a circuit board/ground plane 102 with processor 602, a memory 604, a cellular interface such as a cellular transceiver 610, an active switch 612, and a top antenna feed 106 and main antenna feed 106 in electrical communication with the active switch 612.

The cellular transceiver 610 may be any component or collection of components that allows the device to communicate using a cellular signal, and may be used to receive and/or transmit information over a cellular connection of a cellular network. In some embodiments, the cellular transceiver 610 may be formed a single device, or alternatively, a separate receiver and transmitter. The cellular transceiver 610 may further be in signal communication with a top antenna 108 and main antenna 104 through the top antenna feed 106 and main antenna feed 106, respectively. The processor 602 is configured to transmit or receive signals through the main antenna 104 or top antenna 108 and cellular transceiver 610.

A secondary interface such as a GPS/WiFi transceiver 606 is also disposed on the circuit board 102, with the GPS/WiFi transceiver 606 in electrical communication with a GPS/WiFi controller 608. The GPS/WiFi controller 608 and GPS/WiFi transceiver 606 may, in some embodiments, be a third party device such as a system-on-chip, add-on board or discrete component mounted on the circuit board 102. In other embodiments, the GPS/WiFi controller 608 and GPS/WiFi transceiver 606 are integrated into the circuit board 102, and in some embodiments, the processor 602 may execute portions of the GPS/WiFi communication management. In other embodiments, the secondary interface may be any component or collection of components that allows the device to communicate data or control information via a supplemental protocol. For instance, the secondary interface may be a non-cellular wireless interface for communicating in accordance with a Bluetooth, near field communication, wireless charging, or other wireless protocol.

The GPS/WiFi transceiver may further be in signal communication with a GPS/WiFi antenna 110 through the GPS/WiFi antenna feed 106. The processor 602 is configured to transmit or receive signals through the GPS/WiFi antenna 104, GPS/WiFi controller 602 and GPS/WiFi transceiver 610.

The processor 602 may be any component capable of performing computations and/or other processing related tasks, and the memory 604 may be any component capable of storing programming and/or instructions for the processor 602. In some embodiment, the device further includes a user interface/inputs 616 that are connected to the processor 602 to permit a user to execute or interact with one or more programs running on the processor 602.

Thus, a user may access a wireless communications device and initiate a first communication by way of a first communication service that uses a first band. For example, initiating a telephone call, data request, or the like, may cause the wireless device to transmit data over a cellular network. Such a request causes the wireless communications device to communicate on a first antenna such as the top antenna 108 or main antenna 104. A user may also initiate a second communication by way of a second communication service, such as WiFi or GPS. For example, a user may request a GPS location, which causes the processor 602 to receive a GPS location signal through the GPS/WiFi antenna 110. The second communication uses a second band and causes the wireless communications device to communicate on a second band using a second antenna. Additionally, a request using the first communication service may take place at the same time as using the second communication service. For example, a user may request a map over a cellular network, and also request that the device display the user's location on the map. Therefore, the user initiates the first communication for the map over the cellular network and initiates the second communication on the GPS band for receiving the GPS signal to determine the user's position for display on the map. The antennas 104, 108, 110 may also be utilized automatically by the device without user prompting.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A wireless communication device comprising:

a circuit board;

a cover portion that is substantially radio frequency (RF) opaque and that has an opening;

a first antenna electrically connected to the circuit board at a first feed point of the circuit board; and a second antenna electrically connected to the circuit board at a second feed point, and wherein a first portion of the second antenna extends between the cover portion and the circuit board such that the first portion of the second antenna is exposed through the opening in the cover portion.

2. The wireless communications device of claim 1, wherein the first antenna is configured to communicate in first RF bands;

wherein the second antenna is configured to communicate in second RF bands; and wherein the circuit board is configured to communicate over the first antenna and the second antenna simultaneously.

3. The wireless communication device of claim 2, wherein the first RF bands comprise one or more cellular frequency bands;

wherein the second RF bands comprise a GPS frequency and one or more wireless networking (WiFi) frequency bands; and wherein the first RF bands and the second RF bands comprise overlapping frequencies.

4. The wireless communication device of claim 2, wherein the first portion of the second antenna is configured to have a greater current density than a second portion of the second antenna when resonating in a first frequency of the second RF bands, wherein the first portion of the second antenna is different than the second portion of the second antenna; and wherein the second portion of the second antenna is configured to have a greater current density than the first portion of the second antenna when resonating in one of the one or more second frequency bands of the second RF bands, wherein the first frequency is different from the second frequency bands.

5. The wireless communication device of claim 2, further comprising:

a third antenna connected to the circuit board via a third feed point opposite the circuit board from the first feed point; and circuitry on the circuit board configured to switch between communicating through the first antenna and the third antenna during communication using the first RF bands.

6. The wireless communication device of claim 1, wherein the opening in the cover portion is substantially RF transparent.

7. The wireless communication device of claim 1, wherein at least a portion of the circuit board shields a portion of the second antenna from the first antenna.

8. The wireless communication device of claim 7, wherein at least the portion of the circuit board acts as ground plane for the second antenna and the first antenna during communication over the second antenna.

9. A wireless communication device comprising:

a circuit board having a first transceiver and a second transceiver a cover having a cover portion that is substantially radio frequency (RF) opaque and that has an opening in the cover portion;

a first antenna connected to the first transceiver via a first feed point on the circuit board and configured to communicate in a first radio frequency (RF) band; and a second antenna connected to the second transceiver via a second feed point on the circuit board and configured to communicate in a group of RF bands;

wherein a first portion of the second antenna extends away from the first antenna; and wherein a second portion of the second antenna extends between a first side of the circuit board and the opening in the cover portion.

10. The wireless communications device of claim 9, wherein the cover portion is a back surface of comprises a substantially RF opaque material;

wherein the circuit board, the first antenna and the second antenna are disposed within the cover; and wherein the second portion of the second antenna is disposed between the circuit board and the opening in the back surface such that the second portion of the second antenna radiates and receives radio signals though the opening.

11. The wireless communication device of claim 9, further comprising a shield disposed in the opening, the shield comprising a substantially radio transparent material.

12. The wireless communication device of claim 9, wherein the circuit board shields a portion of the second antenna from the first antenna.

13. The wireless communication device of claim 9, wherein the first portion of the second antenna is disposed on an antenna carrier comprising a dielectric material that is substantially RF transparent.

14. The wireless communication device of claim 9, wherein the first RF band and at least one RF band of the group of RF bands comprise overlapping frequencies.

15. The wireless communication device of claim 14, further comprising a third antenna connected to the first transceiver via a third feed point on the circuit board;

wherein the first antenna is a cellular top antenna; and wherein the third antenna is a cellular main antenna.

16. The wireless communication device of claim 15, wherein the second portion of the second antenna is configured to have a greater current density than the first portion of the second antenna when resonating in a second RF band of the group of RF bands; and wherein the first portion of the second antenna is configured to have a greater current density than the second portion of the second antenna when resonating in a third RF band of the group of RF bands.

17. A method comprising:

providing a user interface on a wireless communications device having a cover disposed around a circuit board, a first antenna connected to the circuit board and a second antenna connected to the circuit board, wherein the first antenna is configured to communicate in a first radio frequency (RF) band, wherein the second antenna is configured to communicate in a second RF band and a third RF band, wherein a first portion of the second antenna extends away from the first antenna, and wherein a second portion of the second antenna extends between the circuit board and an opening in a cover portion that is a substantially RF opaque portion of the cover;

performing a first communication in response to a user input through the user interface and by way of a first communication service causes the wireless communications device to communicate on the first antenna using the first RF band; and performing a second communication by way of a second communication service that causes the wireless communications device to communicate on the second antenna using the second RF band at a same time as at least part of the first communication.

18. The method of claim 17, wherein the first RF band and at least one of the second RF band and third RF band comprise at least one overlapping frequency.

19. The method of claim 17, wherein the performing a second communication comprises causing the second antenna to receive radio signals though the opening.

20. The method of claim 17, further comprising performing a third communication by way of a third communication service that causes the wireless communications device to communicate on the second antenna using the third RF band and;

wherein the performing the second communication comprises causing the second antenna to resonate in the second RF band such that the second portion of the second antenna has a greater current density than the first portion of the second antenna; and wherein the performing the third communication comprises causing the second antenna to resonate in the third RF band such that the first portion of the second antenna has a greater current density than the second portion of the second antenna.

* * * * *